US010864759B2

(12) United States Patent
Rubio et al.

(10) Patent No.: US 10,864,759 B2
(45) Date of Patent: Dec. 15, 2020

(54) DEPOSITING PRINT AGENT

(71) Applicant: Hewlett-Packard Development Company, L.P., Spring, TX (US)

(72) Inventors: Leticia Rubio, Sant Cugat del Valles (ES); Raul Rodriguez Alonso, Sant Cugat del Valles (ES); Marti Rius Rossell, Sant Cugat del Valles (ES); Utpal Kumar Sarker, Sant Cugat del Valles (ES); Xavier Quintero Ruiz, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/329,494

(22) PCT Filed: Oct. 24, 2016

(86) PCT No.: PCT/US2016/058503
§ 371 (c)(1),
(2) Date: Feb. 28, 2019

(87) PCT Pub. No.: WO2018/080430
PCT Pub. Date: May 3, 2018

(65) Prior Publication Data

US 2019/0184720 A1 Jun. 20, 2019

(51) Int. Cl.
*B41J 11/00* (2006.01)
*B41J 25/00* (2006.01)
(Continued)

(52) U.S. Cl.
CPC ..... *B41J 25/006* (2013.01); *B41J 2/16517* (2013.01); *B41J 2/17* (2013.01);
(Continued)

(58) Field of Classification Search
CPC ..... B41J 25/006; B41J 2/175; B41J 11/0065; B41J 11/06; B41J 2/2132; B41J 2/17; B41J 2/16517
See application file for complete search history.

(56) References Cited

U.S. PATENT DOCUMENTS 5,028,514 A 7/1991 Johannsen
6,280,023 B1 8/2001 Ufkes
(Continued)

FOREIGN PATENT DOCUMENTS

CN 1066398 C 5/2001
CN 1081988 C 4/2002
(Continued)

OTHER PUBLICATIONS

Canon: PIXMA Manuals, Execute Borderless Printing, < http://ugp01.c-ij.com/ij/webmanual/PrinterDriver/W/MX450%20series/1.0/EN/PPG/Dg-c_borderless.html >, accessed online Feb. 21, 2017.

*Primary Examiner* — Yaovi M Ameh
(74) *Attorney, Agent, or Firm* — HP Inc. Patent Department

(57) ABSTRACT

A method of printing is disclosed. The printing may involve printing on a printable medium using a print head having a plurality of nozzles, the printable medium having a leading edge and a defined zone adjacent to the leading edge. The print head may be to deposit print agent onto the printable medium via the plurality of nozzles during successive printing passes. The method may comprise: during a first printing pass, depositing print agent from a subset of the plurality of nozzles onto the printable medium outside the defined zone. The method may further comprise: advancing the printable medium by a defined distance. The method may further comprise: during a second printing pass, depositing print
(Continued)

agent from a subset of the plurality of nozzles onto the printable medium within the defined zone.

14 Claims, 7 Drawing Sheets

(51) Int. Cl.

| | |
|---|---|
| ***B41J 2/17*** | (2006.01) |
| ***B41J 2/21*** | (2006.01) |
| ***B41J 11/06*** | (2006.01) |
| ***B41J 2/175*** | (2006.01) |
| ***B41J 2/165*** | (2006.01) |

(52) U.S. Cl.
CPC ..... *B41J 2/175* (2013.01); *B41J 2/2132* (2013.01); *B41J 11/0065* (2013.01); *B41J 11/06* (2013.01)

(56) References Cited

U.S. PATENT DOCUMENTS

| | | | |
|---|---|---|---|
| 6,454,389 | B1 | 9/2002 | Couwenhoven |
| 6,871,934 | B2 | 3/2005 | Masuyama et al. |
| 7,387,361 | B1 | 6/2008 | Rueby et al. |
| 7,648,216 | B2 | 1/2010 | See Toh et al. |
| 8,789,907 | B2 | 7/2014 | Vall et al. |
| 9,359,160 | B2 | 6/2016 | Yoshida et al. |
| 9,387,686 | B2 | 7/2016 | Yoshida |
| 2002/0047885 | A1* | 4/2002 | Miyawaki ..... B41J 11/06 347/104 |
| 2004/0212658 | A1* | 10/2004 | Otsuki ..... B41J 11/06 347/41 |
| 2005/0078139 | A1 | 4/2005 | Kang et al. |
| 2005/0206701 | A1 | 9/2005 | Komatsu et al. |
| 2006/0050107 | A1 | 3/2006 | Yamanaka et al. |
| 2006/0209114 | A1* | 9/2006 | Namai ..... B41J 29/393 347/16 |
| 2007/0273899 | A1* | 11/2007 | Yazawa ..... G06K 15/107 358/1.8 |
| 2008/0055352 | A1 | 3/2008 | Toh et al. |
| 2008/0266343 | A1 | 10/2008 | Borrell et al. |
| 2009/0033694 | A1 | 2/2009 | Shi et al. |
| 2014/0152727 | A1 | 6/2014 | Vall et al. |

FOREIGN PATENT DOCUMENTS

| | | | |
|---|---|---|---|
| CN | 100553987 | C | 10/2009 |
| EP | 1228876 | | 8/2002 |
| EP | 1251009 | A1 | 10/2002 |
| EP | 1285767 | | 2/2003 |
| JP | 2002103586 | | 4/2002 |
| JP | 2003127341 | | 5/2003 |
| JP | 2005271231 | | 10/2005 |
| JP | 2006231930 | A | 9/2006 |
| JP | 2006231930 | A | 9/2006 |
| RU | 2096183 | C1 | 11/1997 |
| WO | 2007061138 | | 5/2007 |

* cited by examiner

DEPOSITING PRINT AGENT

BACKGROUND

A printing apparatus may be used to deliver print agent, such as ink, in a pattern onto a substrate, such as a sheet of paper. Some printing apparatus may deliver print agent having a single colour (e.g. monochrome) or varying tones of a single colour (e.g. grayscale) onto a substrate and/or print agent of multiple colours onto a substrate.

A print apparatus may be used to print anywhere on the substrate, including up to the edges of the substrate.

BRIEF DESCRIPTION OF DRAWINGS

Examples will now be described, by way of non-limiting example, with reference to the accompanying drawings, in which.

DETAILED DESCRIPTION

Figure 1A:
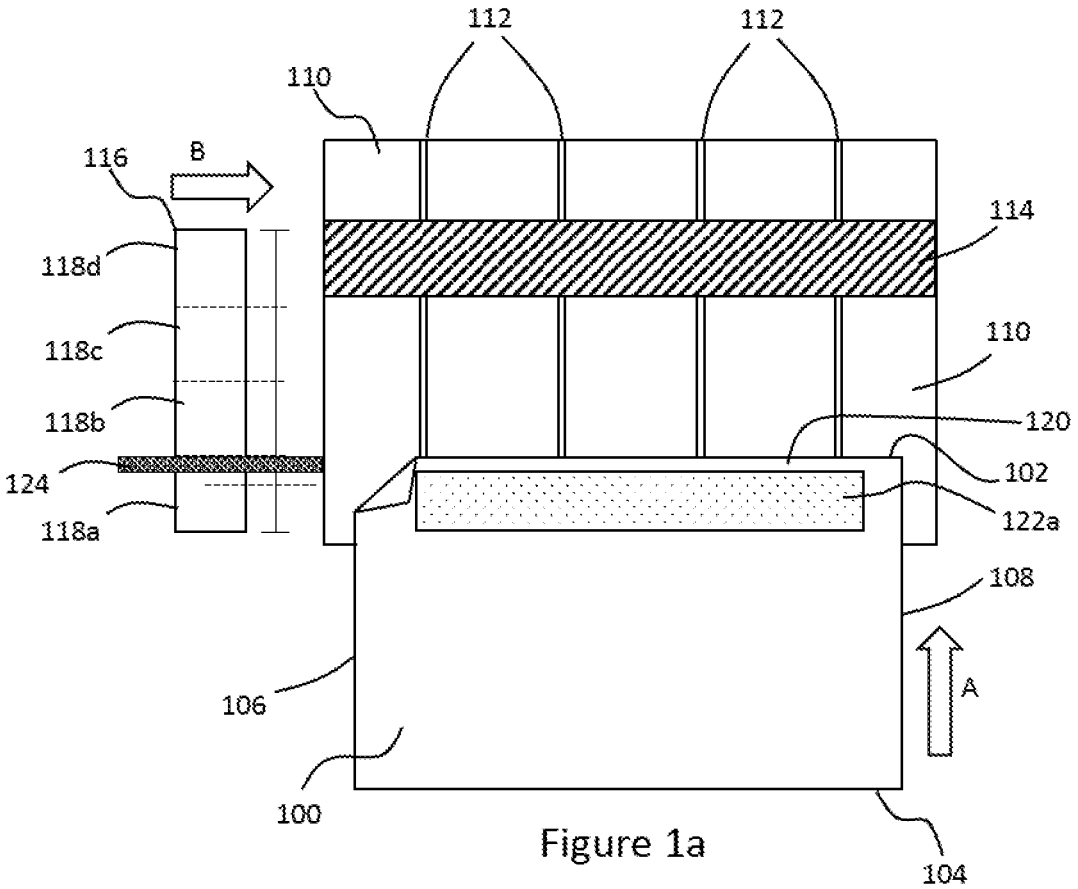
FIG. 1 is a schematic showing an example of four stages of a print job.

A printing apparatus may be used to deliver print agent, such as ink, onto a substrate, such as a sheet of paper as the substrate is moved over a platen. Print agent may be contained in a reservoir. For example, print agent may be held in tanks or cartridges. Print agent may be delivered by a nozzle of a print agent distributor, or print head. For example, print heads fluidly connected to ink tanks may deliver ink from the ink tanks to the print head and deposit ink via nozzles of the print heads onto the substrate in a pattern according to print job data processed, for example by processing apparatus.

A print job may, in some examples, involve the delivery of print agent within a defined zone adjacent to an edge of the substrate and, in some example, up to the edge of the substrate. Printing in this way may be called borderless printing or full bleed printing. When printing at full bleed, the print head may, intentionally or otherwise, deliver print agent to area just beyond the edge of the substrate onto a surface supporting the substrate, for example the platen. If print agent is delivered onto the platen, then that print agent may transfer onto the substrate as the substrate is moved over the platen, thereby damaging the substrate. The platen may, therefore, be provided or supplemented with a portion, for example a print agent-absorbent portion, onto which print agent may be delivered without the risk (or with a lower risk) of that print agent being transferred back onto the substrate inadvertently.

FIG. 1 is a schematic showing an example of four stages of a print job using a print apparatus. In FIGS. 1*a* to 1*d*, a portion of a print apparatus is shown.

A print apparatus is to print onto a substrate 100. The substrate 100 may be any type of printable medium (also called a print medium), and may be a sheet of material, such as paper, capable of receiving print agent. In other examples, the substrate 100 may be a sheet of cardboard, wood, glass, metal, plastics material. The substrate 100 may be any shape. In the example described herein the substrate 100 is substantially rectangular having a leading edge 102, a trailing edge 104, a first side edge 106 and a second side edge 108. In some examples, the substrate 100 may take the form of individual sheets while, in other examples, the substrate may include a roll of material to be printed and cut to a desired length.

The print apparatus includes a print bed which may include a platen 110, which may be a flat surface to support the substrate during the printing process. The substrate 100 may be moved, or advanced, over the platen 110 using a substrate advancer, or advancing system (not shown in FIG. 1), which may include a roller and/or a wheel. In the example shown in FIG. 1, the direction of movement of the substrate 100 over the platen 110 is shown by arrow A. The platen 110 may, in some examples, include a rib 112 extending at least partially over the platen in the direction of movement of the substrate 100, shown by the arrow A. In some examples, the platen 110 may include multiple ribs 112. In the example shown in FIG. 1, the platen 110 includes four ribs 112, but in other examples, more or fewer ribs may be provided. The ribs 112 may extend proud of the platen 110 (that is to say, the ribs may extend slightly upwards from the platen) such that the form a series of ridges. The ribs 112 are provided to support the substrate 100 as the substrate advances over the platen 110.

As noted above, in some examples, the platen 110 may include a portion 114 formed from a print agent-absorbent (e.g. ink-absorbent) material, such as foam. The absorbent portion 114 may have a width equal to a width of the platen 110, such that the absorbent material extends over the width of the platen as shown in the example of FIG. 1. In other examples, the absorbent portion 114 may have a width less than the width of the platen, but the width of the absorbent portion may be greater than a width of the substrate 100 to be printed. In some examples, the absorbent portion 114 may form a part of the platen 110 while, in other examples, the platen may comprise two separate portions separated by the absorbent portion. As can be seen, in the example of FIG. 1, the ribs 112 extend over the platen 110 but not over the absorbent portion 114. In other examples, however, the ribs 112 may extend at least partially over the absorbent portion 114, as discussed below with reference to FIG. 10.

The print apparatus further includes a print agent distributor, or print head 116, having a plurality of nozzles (not shown) via which print agent may be delivered onto the substrate. As used herein, "delivering" print agent includes firing, ejecting or otherwise depositing print agent or print fluid. The selection of the nozzles via which print agent is to be delivered is made by a control unit, or processing apparatus (not shown), and is made based on the pattern to be printed. The nozzles are, in some examples, arranged in an array, and may be arranged in rows (i.e. parallel to the leading edge 102 of the substrate 100 in FIG. 1) and columns (i.e., parallel to the side edges 106, 108 in FIG. 1). During printing, the print head 116 moves over the platen 110 and the substrate 100 in a direction perpendicular to the direction of movement of the substrate, in the direction of arrow B in FIG. 1.

The array of nozzles in the print head 116 may be arranged in subgroups. For example, the nozzles of the print head 116 may be arranged in four subgroups or bands, as shown in FIG. 1. In the example shown in FIG. 1, a first band 118*a* of nozzles is located at a first position in the print head, a second band 118*b* of nozzles is located at a second position in the print head, a third band 118*c* of nozzles is located at a third position in the print head and a fourth band 118*d* of nozzles is located at a fourth position in the print head. Each band of nozzles may be controlled to deliver print agent independently of the others, or two or more of the bands of nozzles may be controlled to deliver print agent simultaneously.

The print head 116 has a length, also called a "height", h, and the length h corresponds to a width of a strip of print agent which may be printed by the print head if all of the nozzles were to fire (i.e. deposit print agent) during a pass over the substrate 100. The area (for example on a substrate) that can be printed by the print head 116 in a single pass may be called a swath. In this context, the number of rows (which may be measured in rows of nozzles or rows of a resulting pattern/image, for example pixel rows) that may be printed may be referred to as a "swath height". The term "pass" is intended to mean a movement of the print head 116 over the substrate during which print agent is deposited. In some examples, print agent may be delivered when the print head 116 moves in the direction B (i.e. from left to right in FIG. 1). After the pass, the print head 116 may return to its starting position (i.e. its position in FIG. 1) before performing a second pass. In other examples, print agent may also be deposited while the print head 116 moves in the direction opposite to the arrow B (i.e. from right to left in FIG. 1). In such an example, each time the print head travels completely over the substrate may be a print pass.

In some examples, the print head 116 may be such that the area to be printed by all of the nozzles, or by all of the bands of nozzles, is completed after multiple passes of the print head. In other words, the swath is completed after multiple passes of the print head 116 over the substrate 100. By using such so-called "multi-pass printing", the resulting print quality may be higher than can be achieved using a single-pass print mode, as a greater amount of print agent may be delivered to the substrate 100. Further, the print agent may be able to dry between each pass of the print head 116, meaning the interaction between fresh print agent delivered during each pass pf the print head with print agent already delivered to the substrate is different to the interaction between print agent and the substrate if the print agent is delivered during a single pass.

FIGS. 1*a* to 1*d* show various stages of a four-pass print job as the substrate 100 is advanced over the platen 110 according to an example. Thus, in this example, a swath is completed after four passes of the print head 116 over the substrate 100 (during which print agent is delivered). Print agent may, in some examples, be delivered onto the substrate by a different band of nozzles during each pass. In the example shown, print agent is to be delivered (printed) onto the substrate 100 up to the leading edge 102. In this example, a defined zone 120 is defined adjacent to the leading edge 102 of the substrate 100, the defined zone defining an area within which print agent is not to be delivered while the leading edge of the substrate 100 is over the platen 110, as is discussed below. The defined zone 120 may be a zone of any shape. In some examples described herein, the defined zone includes an edge of the substrate. The defined zone 120, in some examples, may be considered to be a margin. The margin 120 serves as a boundary beyond which print agent may be printed onto the substrate 100 if the leading edge 102 is over a defined area (such as the absorbent portion 114) of the platen 110.

FIG. 1*a* shows the position of the substrate 100 after completion of a first pass of the print head 116. Prior to the first pass, the substrate 100 may be moved into position by the substrate advancer (or advancing system, not shown). During the first pass, print agent may be delivered via nozzles in the first band 118*a* of nozzles to form a pattern 122*a* on the substrate 110. Depending on the print job data, the pattern printed may include, amongst other things, text, a drawing, a shape and/or a photograph, and may be in black and white (monochrome) or colour. As is shown in FIG. 1*a*, even though the substrate 100 is positioned such that all of the nozzles in the first band 118*a* of nozzles pass over the substrate during the first pass of the print head, a nozzle (or in some examples, a row of nozzles) may not deliver print agent during the first pass. Specifically, a nozzle within a region 124 may not be fired, or may be prevented from delivering print agent onto the substrate 100, as those nozzles are aligned with (i.e. fall within) the margin 120 during the first pass. Thus, during the first pass, a first subset of nozzles in the first band of nozzles may deliver print agent onto the substrate 100 outside the margin 120, and a second subset of nozzles in the first band of nozzles are instructed not to deliver print agent, or are otherwise prevented from delivering print agent onto the substrate within the margin. In this way, in the example shown, the pattern 122*a* formed on the substrate from the first pass of the print head 116 has a smaller width than would be possible if the first band 11 of nozzles were to fire during a pass over a portion of the substrate that did not include the margin 120.

The way in which a nozzle, or a rows of nozzles, of the print head may be prevented from delivering print agent may be achieved in various ways. In some examples, each row of nozzles may be independently instructed by the processing apparatus in accordance with the print job data. In other words, a particular row of nozzles may be instructed to print or not print, based on whether the particular row of nozzles is aligned with the margin 120 of the substrate 100. In other examples, a print mask may be generated and applied to the nozzles of the print head 116. The print mask may be a virtual mask (e.g. a mask defined in computer code) and may comprise a binary code for each nozzle in the print head. In some examples, the print mask may include, for each nozzle, a ONE (1) which corresponds to an instruction for a nozzle to deliver print agent, or a ZERO (0) which corresponds to an instruction for the nozzle not to deliver print agent. As such, the print mask may, in some examples comprise an array of ones and zeroes, each digit defining an instruction for a corresponding nozzle. The print mask may be generated and/or applied by the processing apparatus based on the size of the margin 120 defined for the substrate 100. For example, if a margin for a particular substrate is defined as being 1 mm (i.e. a strip along the leading edge 102 of the substrate 100 having a width of 1 mm), then the processing apparatus may determine that forty rows of nozzles would fire within the margin during a printing pass and, therefore, each nozzle in those forty rows (i.e. the rows of nozzles within the region 124) are masked and instructed not to fire during the first pass.

In the example of FIG. 1, the second, third and fourth bands 118*b*, 118*c*, 118*d* of nozzles of the print head do not pass over the substrate during the first pass and, therefore, nozzles within the second, third and fourth bands may be instructed not to fire during the first pass. Accordingly, the print mask may include a 'zero', or a 'do not fire' instruction for each nozzle in the second, third and fourth bands during the first pass.

In some examples, the print mask may be refreshed, or regenerated after each pass of the print head 116, for example, while the substrate 100 is advanced.

Once the first pass has been completed, and the pattern 122*a* has been printed, the substrate 100 is advanced by a defined distance. In this example, the substrate 100 is advanced in the direction of the arrow A by a distance defined by the number of bands of nozzles in the print head 116. For example, in the case shown in FIG. 1, the print head has a length (height) h and has four bands of nozzles, 118*a*, 118*b*, 118*c* and 118*d*, to be used in a four-pass print mode, so the substrate 100 is advanced by a distance h/4 after the first pass. In this example, therefore, the defined distance (i.e. the distance by which the print head is advanced after a pass) is equal for all passes. In general, however, the print head may be advanced by a difference distance after each printing pass. Thus, in a general case, for an n-pass print mode, a print head 116 of height h (i.e. able to print a swath of swath height h) may make n passes, and the total distance by which the print head is advanced after n passes may be h.

Figure 1B:
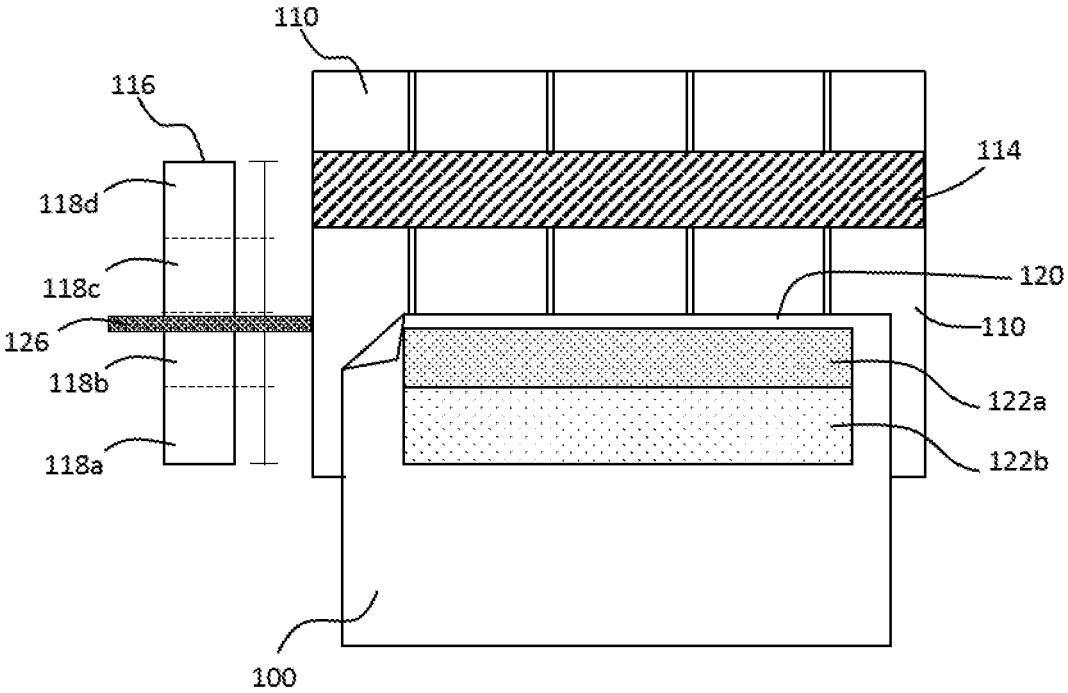

FIG. 1*b* shows the position of the substrate 100 after the substrate has been advanced (following the first pass) and after a second pass of the print head 116. After the substrate has advanced, the pattern 122*a* may be aligned with the second band 118*b* of nozzles in the print head 116, and the first band 118*a* of nozzles may be aligned with a portion of the substrate adjacent to the pattern 122*a*. During the second pass of the print head 116 over the substrate 100, all of the nozzles in the first band 118*a* may be instructed or allowed to fire as none of the rows of nozzles in the first band are aligned with the margin 120 after the substrate has advanced. However, after the substrate has advanced following the first pass, the margin 120 of the substrate 100 is aligned with a nozzle (or a row of nozzles) in the second band 118*b*. Therefore, the processing apparatus may generate and/or apply a print mask in which the a nozzle (e.g. a row of nozzles) within the region 124 are instructed or allowed to fire during the second print pass, but the nozzle (or row of nozzles), which are within a region 126 and therefore are aligned with the margin 120, are not fired or are instructed not to fire during the second print pass. The print mask generated for the second print pass may allow those nozzles or rows of nozzles in the second band 118*b* which are not within the region 126 to fire during the second print pass, along with the nozzles within the first band 118*a*. As in the first print pass, the nozzles within third and fourth bands 118*c*, 118*d* may be prevented from firing/instructed not to fire during the second print pass as those nozzles do not pass over the substrate during the second pass.

During the second pass, those nozzles in the second band 118*b* that are enabled to print (e.g. are not masked by the print mask) may deliver print agent onto the substrate 100 in the same location as the pattern 122*a*. The nozzles in the first band 118*a* may deliver print agent onto the substrate 100 in a pattern 122*b*.

Following the second pass of the print head 116, the substrate 100 may be advanced by a defined distance (which may be the same distance by which the substrate is defined following the first print pass) by the substrate advancer or other advancing system.

Figure 1C:
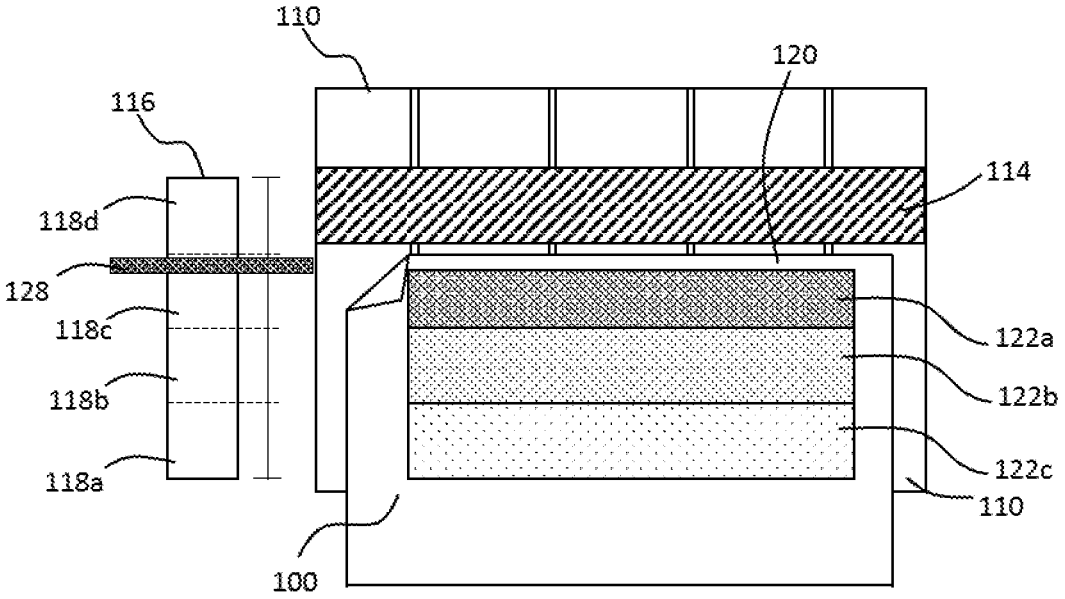

FIG. 1*c* shows the position of the substrate 100 after the substrate has been advanced (following the second pass) and after a third pass of the print head 116. After the substrate has advanced, the pattern 122*a* may be aligned with the third band 118*c* of nozzles in the print head 116, the pattern 122*b* may be aligned with the second band 118*b* of nozzles in the print head 116, and the first band 118*a* of nozzles may be aligned with a portion of the substrate adjacent to the pattern 122*b*. During the third pass of the print head 116 over the substrate 100, all of the nozzles in the first and second bands 118*a*, 118*b* may be instructed or allowed to fire as none of the rows of nozzles in the first and second bands is aligned with the margin 120 after the substrate has advanced. However, after the substrate has advanced following the second pass, the margin 120 of the substrate 100 is aligned with a nozzle (or a row of nozzles) in the third band 118*c*. The processing apparatus may generate and/or apply a print mask in which the nozzle, or rows of nozzles, within the regions 124, 126 are instructed or allowed to fire during the third print pass, but the nozzle, or rows of nozzles, which are within a region 128 and therefore are aligned with the margin 120, are not fired or are instructed not to fire during the third print pass. The print mask generated for the third print pass may allow those nozzles or rows of nozzles in the third band 118*c* which are not within the region 128 to fire during the third print pass, along with the nozzles within the first and second bands 118*a*, 118*b*. As in the first and second print passes, the nozzles within fourth band 118*d* may be prevented from firing/instructed not to fire during the third print pass as those nozzles do not pass over the substrate during the third pass.

During the third pass, those nozzles in the third band 118*c* that are enabled to print (e.g. are not masked by the print mask) may deliver print agent onto the substrate 100 in the same location as the pattern 122*a*, and the nozzles in the second band 118*b* may deliver print agent onto the substrate 100 in the same location as the pattern 122*b*. The nozzles in the first band 118*a* may deliver print agent onto the substrate 100 in a pattern 122*c*.

Following the third pass of the print head 116, the substrate 100 may be advanced by a defined distance (which may be the same distance by which the substrate is defined following the first and second print passes).

Figure 1D:
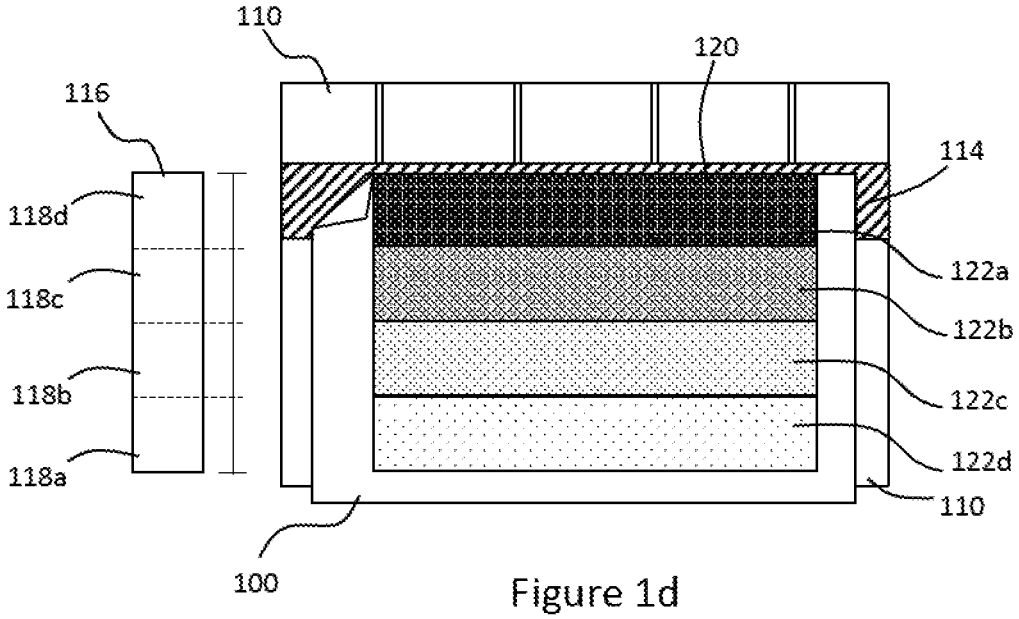

FIG. 1*d* shows the position of the substrate 100 after the substrate has been advanced (following the third pass) and after a fourth pass of the print head 116. After the substrate has advanced, the pattern 122*a* may be aligned with the fourth band 118*d* of nozzles in the print head 116, and the patterns 122*b* and 122*c* may be aligned with the second and third bands 118*b*, 118*c* of nozzles respectively. The first band 118*a* of nozzles may be aligned with a portion of the substrate adjacent to the pattern 122*c*. During the fourth pass of the print head 116 over the substrate 100, all of the nozzles in the first, second and third bands 118*a*, 118*b*, 118*c* may be instructed or allowed to fire as none of the rows of nozzles in those bands are aligned with the margin 120 after the substrate has advanced. After the substrate has advanced following the third pass, the margin 120 of the substrate 100 is aligned with a nozzle (or a row of nozzles) in the fourth band 118*d*. However, in this example, the leading edge 102 of the substrate 100 is positioned over the absorbent portion 114 and, therefore, the leading edge is within a defined area within which print agent may be delivered within the margin 120. Thus, the processing apparatus may generate and/or apply a print mask in which all of the nozzles of the print head 116 are instructed or allowed to fire during the fourth print pass.

During the fourth pass, the nozzles in the second and third bands 118*b*, 118*c* may deliver print agent onto the substrate 100 in the same locations as the patterns 122*c* and 122*b* respectively, and the nozzles in the first band 118*a* may deliver print agent onto the substrate 100 in a pattern 122*d*. The nozzles in the fourth band 118*d* may deliver print agent onto the substrate in the same location as the pattern 122*a* and in the margin 120. Those nozzles which are aligned with the margin 120 during the fourth print pass may be instructed to deliver relatively more print agent within the margin 120 than those nozzles delivering print agent outside the margin so that a density of print agent printed within the margin is the same as, or similar to, a density of print agent printed outside the margin during the fourth pass and previous passes.

Following the fourth pass of the print head 116, the swath is complete, and the substrate 100 may be advanced over the platen 110 by a defined distance (which may be the same distance by which the substrate is defined following the first, second and third print passes) to begin printing a new swath.

As noted above, the example described above with reference to FIG. 1 relates to a four-pass print operation, in which the margin 120 of the substrate is printed in the fourth print pass. In other examples, however, print operations may involve a smaller or greater number of print passes to complete a swath and, in some examples, the distance by which the substrate 100 is advanced after each print pass may be relatively smaller than in the four-pass example. As such, in some examples, the edge 102 of the substrate may be positioned over the absorbent portion 114 for two or more print passes. In such scenarios, print agent may be delivered onto the substrate 100 within the margin 120 during two different print passes, which may result in a relatively higher quality print, as the print agent intended to print in the margin may be divided between multiple passes. In some examples where the margin 120 is printed over multiple print passes, the print agent to be delivered may be divided evenly between the multiple print passes while, in other examples, the proportion of print agent to be delivered during a print pass of the multiple print passes may be more or less than the proportion of print agent to be delivered during other print passes.

Figure 2:
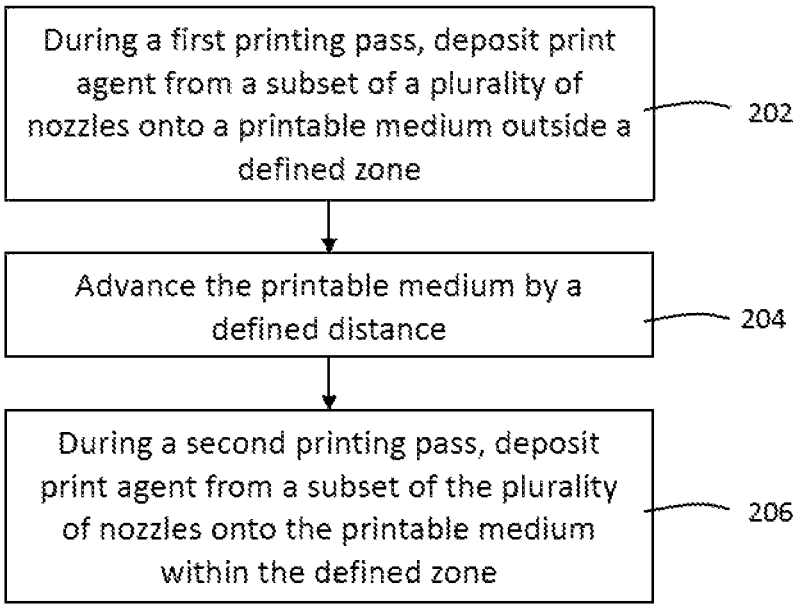
FIG. 2 is a flowchart of an example of a method of printing within a defined zone.

FIG. 2 is a flowchart of an example method of printing on a printable medium. The method of print may use a print head having a plurality of nozzles. The printable medium may have a leading edge and a defined zone adjacent to the leading edge. The print head may deposit print agent onto the printable medium via the plurality of nozzles during successive printing passes. The method comprises, at block 202, depositing, during a first printing pass, print agent from a subset of the plurality of nozzles onto the printable medium outside the defined zone. Thus, as in the example described above, some of the nozzles of the print head may deliver print agent onto the printable medium, or substrate, during the first print pass, while other nozzles in the print head may not deliver print agent during the first print pass.

The method further comprises, at block 204, advancing the printable medium by a defined distance. The defined distance may be determined based on the number of passes to be made to complete a single swath, and on the length h of the print head. In block 206, the method further comprises depositing, during a second printing pass, print agent from a subset of the plurality of nozzles onto the printable medium within the defined zone. The subset of nozzles via which print agent may be deposited during the second printing pass may be different to the subset of nozzles via which print agent may be deposited during the first printing pass.

Figure 3:
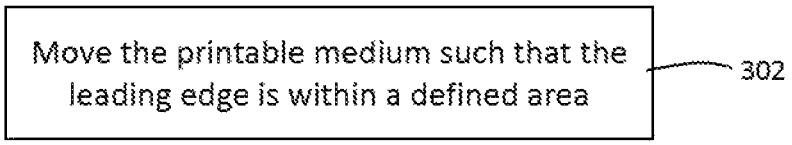
FIG. 3 is a flowchart of an example of a method of printing within a defined zone.

FIG. 3 is a flowchart of an example of a method of printing on a printable medium. Advancing the printable medium may involve, in block 302, moving the printable medium such that the leading edge is within a defined area. The defined area may, in some examples, be a region or area within which print agent may be delivered onto the printable medium within the defined zone. In some examples, the defined area may be an area above an absorbent material.

Figure 4:
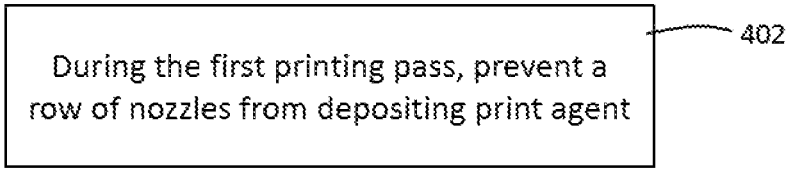
FIG. 4 is a flowchart of an example of a method of printing within a defined zone.

The method may include selectively allowing or causing a particular nozzle to deliver print agent and/or preventing a particular nozzle from deposited print agent. FIG. 4 is a flowchart of an example of a method of printing on a printable medium in which a nozzle is prevented from deposited print agent. In some examples, during the first printing pass, a row of nozzles of the plurality nozzles may be aligned with the defined zone. The method may comprise, in block 402, preventing, during the first printing pass, the row of nozzles from depositing print agent. In some examples, the nozzles may be prevented from depositing print agent if the nozzles are not aligned with defined area, or if the nozzles are not to pass over the defined area during a printing pass.

Figure 5:
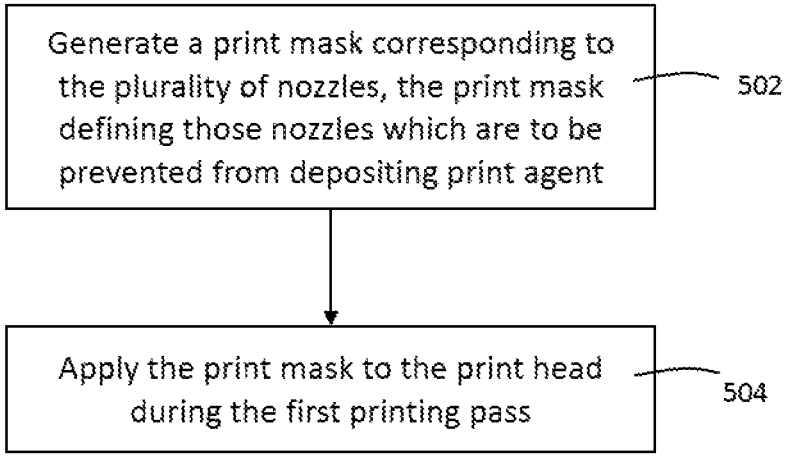
FIG. 5 is a flowchart of an example of a method of printing within a defined zone.

As noted above, the prevention of particular nozzles from depositing print agent may be achieve using a print mask. FIG. 5 is a flowchart of an example of a method of printing on a printable medium in which a print mask may be used. The method (or the preventing of the deposition of print agent) may include, in block 502, generating a print mask corresponding to the plurality of nozzles, the print mask defining those nozzles which are to be prevented from depositing print agent. The method may further include, in block 504, applying the print mask to the print head during the first printing pass. The print mask may, in some examples, be a binary print mask. In some examples, the print mask may include a corresponding instruction for each nozzle of the print head, such that each nozzle can be independently instructed to deposit or not deposit print agent.

Figure 6:
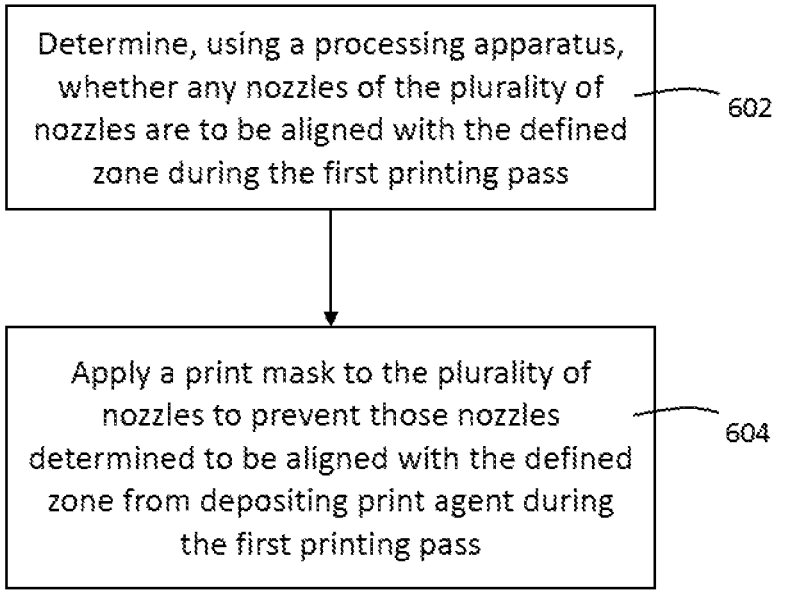
FIG. 6 is a flowchart of an example of a method of printing within a defined zone.

FIG. 6 is a flowchart of an example of a method of printing on a printable medium in which it may be determined whether particular nozzles are aligned with the defined zone, or with the leading edge of the printable medium. In block 602, the method may include, prior to the first pass, determining, using a processing apparatus, whether any nozzles of the plurality of nozzles are to be aligned with the defined zone during the first printing pass. In some examples, those nozzles which are aligned with the defined zone, or with the leading edge of the printable medium, are not to be printed during the first print pass and, therefore, it may be intended that those nozzles are not to deposit print agent during the first pass. Thus, the method may include, in block 604, applying a print mask to the plurality of nozzles to prevent those nozzles determined to be aligned with the defined zone from depositing print agent during the first printing pass.

Figure 7:
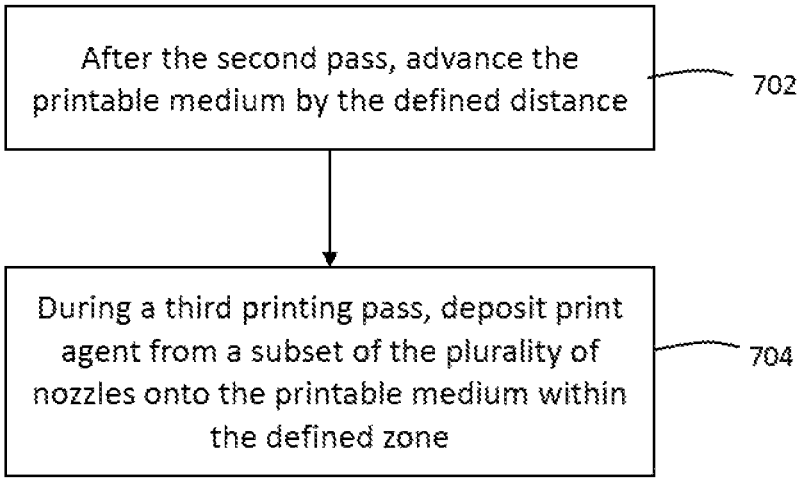
FIG. 7 is a flowchart of an example of a method of printing within a defined zone.

As noted above, in the discussion of the example shown in FIG. 1, multiple nozzles or rows of nozzles may deposit print agent onto the printable medium within the defined zone during multiple print passes. Such an example is shown in the flowchart of FIG. 7. In block 702, the method may include advancing the printable medium by the defined distance after the second pass. The method may include, in block 704, depositing, during a third printing pass, print agent from a subset of the plurality of nozzles onto the printable medium within the defined zone. Thus, during the second and third printing passes, print agent may be deposited within the defined zone. In some examples, the leading edge of the printable medium is within the defined area (which may be above the absorbent material/portion) during both the second and third printing passes.

Figure 8:
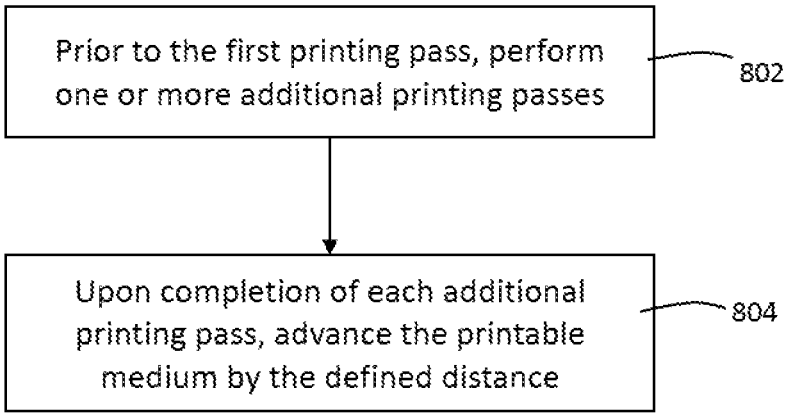
FIG. 8 is a flowchart of an example of a method of printing within a defined zone.

FIG. 8 is a flowchart of an example of a method of printing on a printable medium in which preliminary print passes are made prior to the first print pass. The method may comprise, in block 802, prior to the first printing pass, performing an additional printing pass. In some examples, the method may comprise performing multiple printing passes prior to the first printing pass. In block 804, the method may comprise advancing the printable medium by the defined distance upon completion of each additional printing pass. The additional printing passes may be equivalent to the first and second passes discussed with reference to FIG. 1 above. In some examples, during each additional printing pass, print agent may be deposited from a subset of the plurality of nozzles onto the printable medium outside the defined zone. In other words, in all of the additional (preliminary) printing passes, nozzles may not deposit print agent within the defined zone. The number of additional printing passes may be based on the number of print passes to be performed to print a swath.

Figure 9:
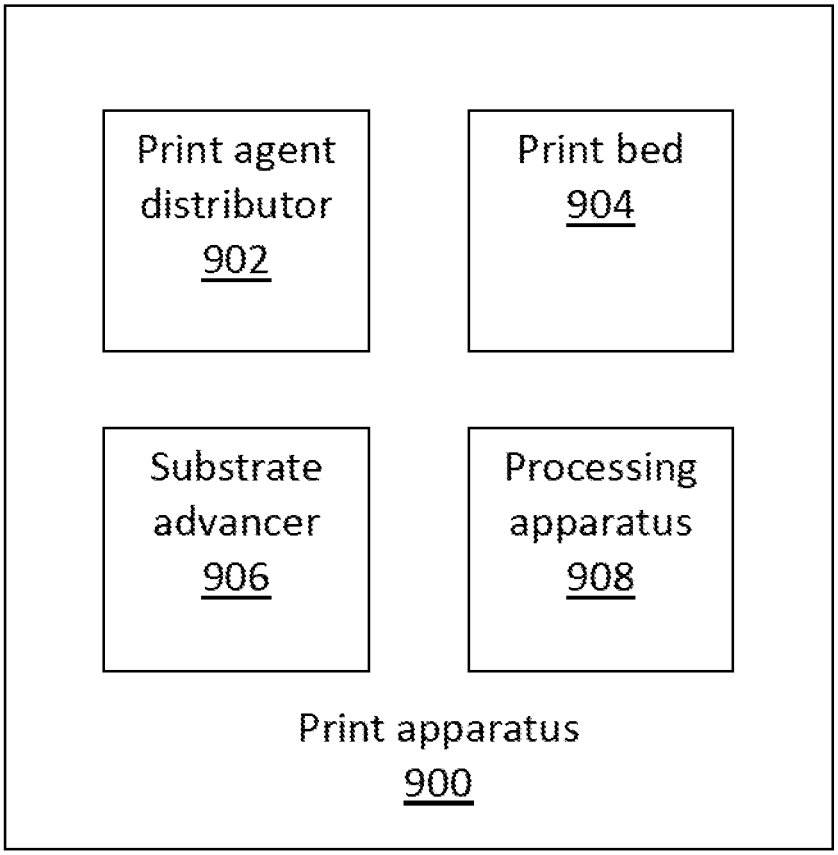
FIG. 9 is a schematic of an example print apparatus.

The method disclosed above may be performed by a printing apparatus. FIG. 9 is a schematic showing an example of a portion of a print apparatus 900. The print apparatus 900 may comprise a print agent distributor 902 having a plurality of nozzles to deposit print agent onto a substrate during successive printing passes, the substrate having a leading edge and a defined zone adjacent to the leading edge. The print apparatus 900 may also comprise a print bed 904 having a platen to support the substrate, and a print agent-absorbing element (114, FIG. 1). The print apparatus 900 may also comprise a substrate advancer 906 to advance the substrate over the print bed 904. The print apparatus 900 may also comprise processing apparatus 908. The processing apparatus 908 may control the print agent distributor 902 to deposit print agent, during a first printing pass, from a subset of the plurality of nozzles onto the substrate outside the defined zone. The processing apparatus 908 may control the substrate advancer 906 to move the substrate by a defined distance. The processing apparatus 908 may control the print agent distributor 902 to deposit print agent, during a second printing pass, from a subset of the plurality of nozzles onto the substrate inside the defined zone.

In some examples, the print agent-absorbing element 114 of the print bed 904 may extend beyond a length of the leading edge of the substrate 100. The print agent absorbing element 114 may, in some examples, comprise a print agent-absorbing foam.

Figure 10:
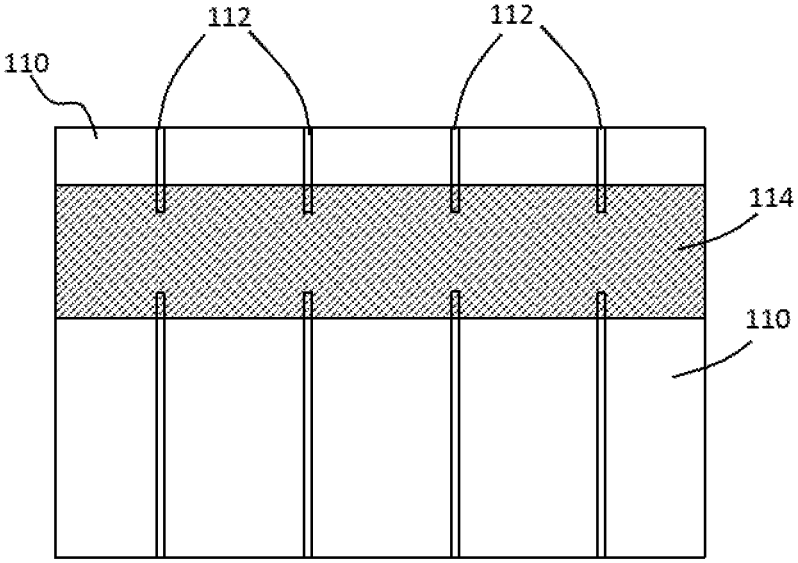
FIG. 10 is a schematic showing an example of components of a print apparatus.

In some examples, the print bed 904 may comprise a plurality of ribs 112 extending from the platen, the ribs being to support the substrate. In some examples, such as the example shown in FIG. 1, the ribs 112 may not extend over the print agent-absorbing element 114. In such examples, the ribs 112 may extend over the platen. In other examples, the ribs 112 extend partially over the print agent-absorbing element 114. Such an example is shown in FIG. 10, which is a schematic showing an example of a portion of a print apparatus. FIG. 10 shows a platen 110 having a print-agent absorbing portion 114 extending across the width of the platen. The arrangement differs from the example arrangement shown in FIG. 1 in that the print-agent absorbing portion 114 of the example shown in FIG. 10 is larger than in FIG. 1. Furthermore, the ribs 112 extend partially over the print-agent absorbing portion 114 in the example shown in FIG. 10. With the example of FIG. 10, the print-agent absorbing portion 114 may be larger because the ribs 112 may support the substrate 100 as the substrate advances over the print-agent absorbing portion. In this way, print agent may be deposited onto the substrate 100 between adjacent ribs 112 over the print-agent absorbing portion 114, and a print mask may be applied to particular nozzles to prevent print agent from being deposited in the defined zone directly over the ribs. Portions of the defined zone between the ribs may be printed during a pass, and the relatively smaller portions of the defined zone directly over the ribs may be printed during a subsequent pass. The larger print agent-absorbing portion may allow printing within the defined zone to be performed during multiple passes, which may provide a relatively high quality print, and/or may allow for a relatively high density of print agent to be deposited in the defined zone. This may also reduce the burden on particular nozzles which may otherwise deposit relatively large amounts of print agent during a single pass.

In some examples, a print absorbing element may be provided at a location between the ribs 112 as an alternative to, or in addition to, the element 114, In some examples, the processing apparatus 908 may determine that a row of nozzles of the print agent distributor 902 is aligned with the defined zone. The processing apparatus 908 may, in some examples, prevent the row of nozzles that is aligned with the defined zone from depositing print agent during the first pass.

Figure 11:
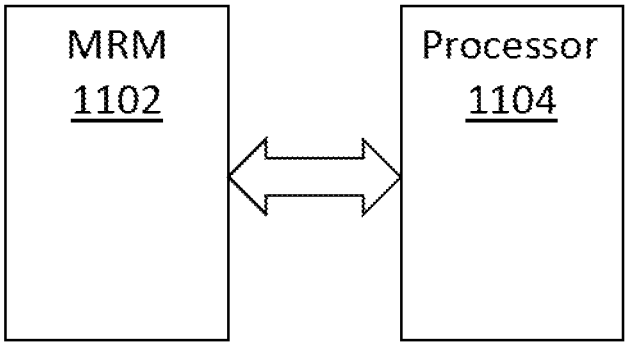
FIG. 11 is a schematic of an example machine-readable medium with a processor to perform a method of printing within a defined zone.

FIG. 11 shows a machine-readable medium 1102 associated with a processor 1104. The machine-readable medium 1102 comprises instructions which, when executed by the processor 1104, cause the processor 1104 to deliver ink from some of a plurality of nozzles of a print head, during a first pass of the print head, onto a printable medium outside a defined zone, the defined zone being adjacent to a leading edge of the printable medium The machine-readable medium 1102 may comprise instructions which, when executed by the processor 1104, cause the processor 1104 to move the printable medium by a defined distance to a position such that the leading edge of the printable medium is over an ink-absorbing element.

The machine-readable medium 1102 may comprise instructions which, when executed by the processor 1104, cause the processor 1104 to deliver ink from some of the plurality of nozzles, during a second pass of the print head, onto the printable medium within the defined zone.

Figure 12:
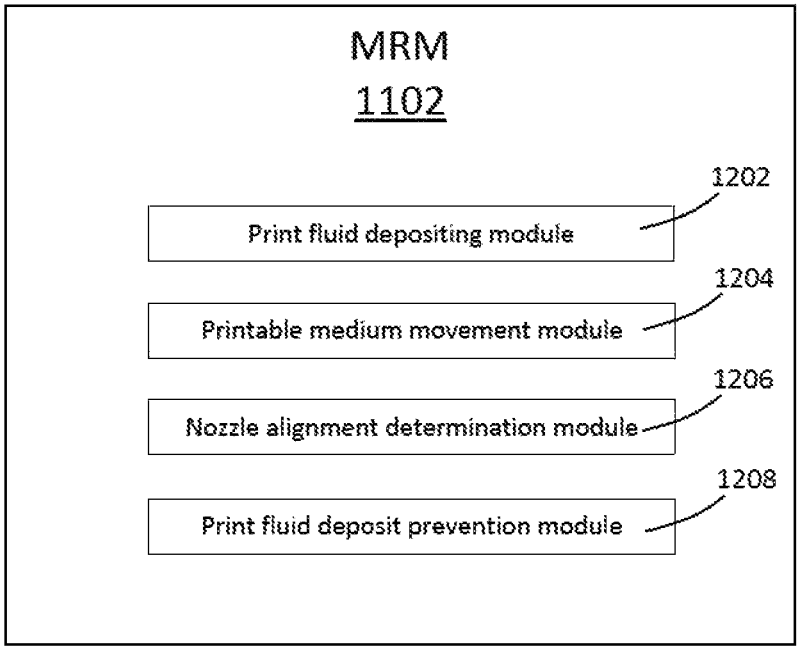
FIG. 12 is a schematic of an example machine-readable medium.

FIG. 12 is a schematic of an example of the machine-readable medium 1102. In some examples, the machine-readable medium 1102 may comprise modules which, together with the processor 1104, may perform functions, such as the functions performed by the processor of FIG. 11. The machine-readable medium 1102 may, in some examples comprise a print fluid depositing module 1202. In some examples, the machine-readable medium 1102 may comprise a printable medium movement module 1204. In some examples, the machine-readable medium 1102 may include a nozzle alignment determination module 1206. The machine-readable medium 1102 may, in some examples, include a print fluid deposit prevention module 1208.

Examples in the present disclosure can be provided as methods, systems or machine readable instructions, such as any combination of software, hardware, firmware or the like. Such machine readable instructions may be included on a computer readable storage medium (including but is not limited to disc storage, CD-ROM, optical storage, etc.) having computer readable program codes therein or thereon.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that each flow and/or block in the flow charts and/or block diagrams, as well as combinations of the flows and/or diagrams in the flow charts and/or block diagrams can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A method of printing on a printable medium using a print head having a plurality of nozzles, the printable medium having a leading edge and a defined zone adjacent to the leading edge, wherein the print head is to deposit print agent onto the printable medium via the plurality of nozzles during successive printing passes, the method comprising:

during a first printing pass, depositing print agent from a subset of the plurality of nozzles onto the printable medium outside the defined zone;

after the first pass, advancing the printable medium by a defined distance;

during a second printing pass, depositing print agent from a subset of the plurality of nozzles onto the printable medium within the defined zone;

after the second pass, advancing the printable medium by the defined distance; and during a third printing pass, depositing print agent from a subset of the plurality of nozzles onto the printable medium within the defined zone.

2. A method according to claim 1, wherein advancing the printable medium comprises moving the printable medium such that the leading edge is within a defined area.

3. A method according to claim 1, wherein, during the first printing pass, a row of nozzles of the plurality nozzles is aligned with the defined zone; and the method further comprises:

during the first printing pass, preventing the row of nozzles from depositing print agent.

4. A method according to claim 3, wherein the preventing comprises:

generating a print mask corresponding to the plurality of nozzles, the print mask defining those nozzles which are to be prevented from depositing print agent; and applying the print mask to the print head during the first printing pass.

5. A method according to claim 1, further comprising, prior to the first printing pass:

determining, using a processing apparatus, whether any nozzles of the plurality of nozzles are to be aligned with the defined zone during the first printing pass;

applying a print mask to the plurality of nozzles to prevent those nozzles determined to be aligned with the defined zone from depositing print agent during the first printing pass.

6. A method according to claim 1, further comprising:

prior to the first printing pass, performing an additional printing pass; and upon completion of the additional printing pass, advancing the printable medium by a defined distance;

wherein, during the additional printing pass, print agent is deposited from a subset of the plurality of nozzles onto the printable medium outside the defined zone.

7. A print apparatus comprising:

a print agent distributor having a plurality of nozzles to deposit print agent onto a substrate during successive printing passes, the substrate having a leading edge and a defined zone adjacent to the leading edge;

a print bed having a platen to support the substrate, and a print agent-absorbing element;

a substrate advancer to advance the substrate over the print bed; and processing apparatus to:

control the print agent distributor to deposit print agent, during a first printing pass, from a subset of the plurality of nozzles onto the substrate outside the defined zone;

after the first printing pass, control the substrate advancer to move the substrate by a defined distance;

control the print agent distributor to deposit print agent, during a second printing pass, from a subset of the plurality of nozzles onto the substrate inside the defined zone;

after the second printing pass, control the substrate advancer to move the substrate by the defined distance; and control the print agent distributor to deposit print agent, during a third printing pass, from a subset of the plurality of nozzles onto the substrate inside the defined zone.

8. A print apparatus according to claim 7, wherein the print bed comprises:

a plurality of ribs extending from the platen, the ribs being configured to support the substrate;

wherein the ribs do not extend over the print agent-absorbing element.

9. A print apparatus according to claim 7, wherein the print bed comprises:

a plurality of ribs extending from the platen, the ribs being to support the substrate;

wherein the ribs extend partially over the print agent-absorbing element.

10. A print apparatus according to claim 7, wherein the processing apparatus is to:

determine that a rows of nozzles of the print agent distributor is aligned with the defined zone; and prevent the row of nozzles which is aligned with the defined zone from depositing print agent during the first pass.

11. A print apparatus according to claim 7, wherein the print agent-absorbing element extends beyond a length of the leading edge of the substrate.

12. A print apparatus according to claim 7, wherein the print agent-absorbing element comprises a print agent-absorbing foam.

13. A non-transitory machine-readable medium comprising instructions which, when executed by a processor, cause the processor to:

deposit print fluid from some of a plurality of nozzles of a print head, during a first pass of the print head, onto a printable medium outside a defined zone, the defined zone being adjacent to a leading edge of the printable medium;

after the first pass, move the printable medium by a defined distance to a position such that the leading edge of the printable medium is over a fluid-absorbing element;

deposit print fluid from some of the plurality of nozzles, during a second pass of the print head, onto the printable medium within the defined zone;

after the first pass, move the printable medium by the defined distance; and deposit print fluid from some of the plurality of nozzles, during a third pass of the print head, onto the printable medium within the defined zone.

14. A non-transitory machine-readable medium according to claim 13, comprising instructions which, when executed by a processor, cause the processor to:

determine that a row of nozzles of the print head is aligned such that, print fluid deposited from the row of nozzles during the first pass would print within the defined zone; and prevent the row of nozzles from depositing print fluid during the first pass.

* * * * *